US008028444B2

(12) United States Patent
Heinz et al.

(10) Patent No.: US 8,028,444 B2
(45) Date of Patent: Oct. 4, 2011

(54) APPARATUS FOR FEEDING ITEMS OF LAUNDRY TO A LAUNDRY-TREATMENT ARRANGEMENT, IN PARTICULAR A MANGLE

(75) Inventors: Engelbert Heinz, Vlotho (DE); Friedhelm Mehrhoff, Hille (DE); Jurgen Sielermann, Heubach (DE); Lars Herzog, Bielefeld (DE)

(73) Assignee: Herbert Kannegiesser GmbH (DE)

( * ) Notice: Subject to any disclaimer, the term of this patent is extended or adjusted under 35 U.S.C. 154(b) by 381 days.

(21) Appl. No.: 12/141,987

(22) Filed: Jun. 19, 2008

(65) Prior Publication Data

US 2009/0260950 A1 Oct. 22, 2009

(30) Foreign Application Priority Data

Jun. 20, 2007 (DE) ..... 10 2007 028 830
Aug. 28, 2007 (DE) ..... 10 2007 040 465

(51) Int. Cl.
*D06F 67/04* (2006.01)
*D06F 69/00* (2006.01)

(52) U.S. Cl. ..... 38/143

(58) Field of Classification Search ..... 38/143, 38/7, 8; 198/574, 456
See application file for complete search history.

(56) References Cited

U.S. PATENT DOCUMENTS

| | | | | |
|---|---|---|---|---|
| 3,756,588 | A * | 9/1973 | Gerstenberger | 38/143 |
| 4,093,205 | A * | 6/1978 | Kober | 493/425 |
| 5,349,768 | A * | 9/1994 | Ishihara et al. | 38/143 |
| 5,425,190 | A * | 6/1995 | Jensen | 38/143 |
| 5,440,810 | A * | 8/1995 | Borucki et al. | 38/143 |
| 5,515,627 | A * | 5/1996 | McCabe | 38/143 |
| 5,606,811 | A * | 3/1997 | Jensen | 38/143 |

FOREIGN PATENT DOCUMENTS

| | | | |
|---|---|---|---|
| DE | 17 60 596 | A1 | 12/1971 |
| DE | 25 58 465 | A1 | 7/1977 |
| DE | 693 09 545 | T2 | 11/1997 |
| EP | 0 573 810 | A1 | 12/1993 |
| EP | 0 620 310 | A1 | 10/1994 |
| JP | 11 114296 | A | 4/1999 |
| WO | 92/18682 | | 10/1992 |

OTHER PUBLICATIONS

Opposition of Jensen issued in corresponding German Application No. 10 2007 040 465.6-26 issued (Jun. 25, 2009).
European Search Report, Oct. 1, 2008; European Patent Office, Munich, Germany.

* cited by examiner

*Primary Examiner* — Ismael Izaguirre
(74) *Attorney, Agent, or Firm* — Laurence P. Colton; Smith Risley Tempel Santos LLC

(57) ABSTRACT

An apparatus for feeding items of laundry to a mangle having loading clamps (27) arranged on conveyors (20) having endless toothed belts (21), the loading clamps (27) being driven in circulation, and if the respective toothed belts (21) are assigned a plurality of the loading clamps (27), the cycle times can be reduced.

21 Claims, 5 Drawing Sheets

APPARATUS FOR FEEDING ITEMS OF LAUNDRY TO A LAUNDRY-TREATMENT ARRANGEMENT, IN PARTICULAR A MANGLE

STATEMENT OF RELATED APPLICATIONS

The present application claims convention priority on German Patent Application Nos. 10 2007 028 830.3 having a filing date of 20 Jun. 2007 and 10 2007 040 465.6 having a filing date of 28 Aug. 2007, both of which are incorporated herein in their entireties by this reference.

BACKGROUND OF THE INVENTION

1. Technical Field

The invention relates to an apparatus for feeding items of laundry to a laundry-treatment arrangement, in particular a mangle, having a feed conveyor, having a spreading arrangement which is arranged upstream of the feed conveyor and has at least two spreading clamps which can be displaced transversely upstream of the feed conveyor, and having at least one loading station upstream of the spreading arrangement, the at least one loading station having a loading location, which is arranged at a lower level than the spreading clamps and at least one conveying arrangement, which slopes up obliquely to the higher-level spreading clamps and has at least one loading clamp.

Apparatuses of the type mentioned here serve for feeding items of laundry mechanically to a mangle or some other laundry-treatment arrangement. An item of laundry is introduced by hand into loading clamps by way of opposite corners of one edge. The loading clamps transfer the item of laundry to spreading clamps. The item of laundry is spread out by the spreading clamps. Each spread-out item of laundry hanging on the spreading clamps is then deposited, with the spread-out front edge in front, on a feed conveyor or on a depositing strip and is transferred from the latter on to the feed conveyor. From the feed conveyor the item of laundry is then fed, in a spread-out state, to the mangle or some other laundry-treatment arrangement.

2. Related Art

In order for it also to be possible for large items of laundry to be spread out by the spreading clamps such that they hang freely, it is necessary for the spreading clamps to be arranged at a correspondingly high level. In order that the operator need not raise the item of laundry to the extent where it can be fitted into the loading clamps in the state in which it hangs down freely, it is known from EP 0 554 205 B1 to arrange the loading clamps on carriages which can be displaced on upwardly sloping rails to higher-level spreading clamps. Once the item of laundry has been moved off on the rails and transferred to the spreading clamps, by the carriages bearing the loading clamps, the empty loading clamps have to be moved back again along the rails, into the bottom loading position. The operator thus has to wait at the respective loading station until the empty loading clamps have moved back again into the bottom loading position. This reduces the throughput of the known apparatus.

BRIEF SUMMARY OF THE INVENTION

The object of the invention is to provide an apparatus which is intended for feeding items of laundry to a laundry-treatment arrangement, in particular a mangle, and makes a greater introduction capacity possible.

An apparatus for achieving this object is an apparatus for feeding items of laundry to a laundry-treatment arrangement, in particular a mangle, having a feed conveyor, having a spreading arrangement which is arranged upstream of the feed conveyor and has at least two spreading clamps which can be displaced transversely upstream of the feed conveyor, and having at least one loading station upstream of the spreading arrangement, the at least one loading station having a loading location, which is arranged at a lower level than the spreading clamps and at least one conveying arrangement, which slopes up obliquely to the higher-level spreading clamps and has at least one loading clamp. Since the respective conveying arrangement has at least one circulating conveyor, the at least one empty loading clamp no longer needs be moved back along the rail by the carriage. Rather, the respective loading clamp is moved back to the loading location from the transfer location, in the region of the spreading clamps, on the endless path formed by the respective conveyor. The endless conveyor allows higher transporting speeds, to be precise in particular because the moving parts of the conveyors, which are driven in circulation, are more lightweight than the carriage, which in the case of the known apparatus can be displaced on a rail.

Provision is preferably made for the or each circulating conveyor to be assigned at least one loading clamp. The respective loading clamp is driven directly by the conveyor and this renders superfluous a carriage which can be displaced along a rail. In particular, the at least one loading clamp is assigned directly to the conveyor, in which case the respective conveyor not only advances, but also carries, the loading clamp.

In the case of a preferred configuration of the apparatus according to the invention, it is provided that each conveyor has a plurality of loading clamps, which preferably follow one after the other at intervals. Assigning a plurality of loading clamps to each conveyor means that at least one empty loading clamp is available at the loading location in order to receive the next item of laundry even when at least one loading clamp on the conveyor has already been loaded with an item of laundry. The conveyors thus perform a kind of storage function for the intermittent interim storage of at least one item of laundry hanging on loading clamps, and only very short distances are necessary until the next empty loading clamp is located in the loading station.

In the case of an advantageous configuration of the apparatus, the at least one conveyor has an endless conveying strand. The at least one loading clamp is then preferably fastened directly on the conveying strand. The conveying strand then carries the at least one loading clamp. The conveying strand of each conveyor is guided around deflecting and driving drums, which have horizontal axes of rotation. The sections of each endless conveying strand are thus located one above the other to form a top section and bottom section. In particular on the top section, the respective loading clamp is easily accessible to the operator in order for the respective corner of an item of laundry to be fitted in. The conveying strand may preferably be formed by a belt, cable or chain. In particular a flat, strap-like belt may be provided in the form of a toothed belt, as a result of which reliable synchronization is ensured.

The conveying strand of the at least one conveyor is preferably assigned a plurality of loading clamps which follow one after the other at intervals. Preferably a plurality of loading clamps are fastened at equal intervals on the respective conveying strand. This fastening takes place in particular such that the loading clamps are distributed on the top section and beneath the bottom section of the endless conveying strand.

Since the pulling strands of the conveyors are endless, they are particularly suitable for a plurality of loading clamps. This means that, once an item of laundry has been fitted into a pair of adjacent loading clamps, the next pair of loading clamps is very rapidly available to the respective loading stations because, for this purpose, all that is required is for the circulating drive strands to be advanced by a short distance, that is to say the spacing between two successive loading clamps.

According to a development of the invention, the conveying arrangement assigned to each loading station has two circulating conveyors. The two conveyors of each conveying arrangement are preferably spaced apart one beside the other, and parallel to one another, and/or can be driven synchronously in circulation. The two corners of the item of laundry are then assigned a dedicated conveyor in each case. The adjacent corners of the front edge of each item of laundry can thus be introduced particularly easily into a loading clamp of each conveyor. The separate conveyors with in each case at least one loading clamp for a respective corner of the item of laundry may be arranged in a desired, advantageous spacing between the loading clamps for retaining opposite corners of the front edge of the item of laundry.

Provision is preferably made for the loading clamps, or if appropriate also just a single loading clamp, to be arranged in a pivotable manner on the respective conveyor. The loading clamps preferably can be pivoted in relation to the conveying strand. In order for an item of laundry to be fitted in, it is thus possible for the loading clamps to assume a position different from that for transferring the item of laundry to the spreading clamps. Since the transfer of the item of laundry from the loading clamps to the spreading clamps should only take place in a certain relative position of the loading clamps in relation to the spreading clamps, the pivotability of the loading clamps in relation to the conveying strand in order for an item of laundry to be fitted in makes it possible for the loading clamps to be pivoted into a ergonomically advantageous position. In the loading position, the elongate clamping mouths of the loading clamps, in order for an item of laundry to be fitted in, preferably run approximately perpendicularly, or slightly obliquely, in relation to the conveying strand. The elongate clamp mouths are then oriented obliquely upwards, that is to say they are directed toward the operator. In contrast, in order for the item of laundry to be transferred to the spreading clamps, by virtue of the loading clamps being pivoted, the elongate clamping mouths are oriented parallel to the conveying strand in the region where the item of laundry is transferred to the spreading clamps. This allows particularly reliable transfer of the item of laundry to the spreading clamps. In particular, the corners or corner regions of an item of laundry can slide more easily out of the clamping mouths of the loading clamps once the spreading clamps have gripped the corners or corner regions.

The loading clamps, or if appropriate, just the single loading clamp, may be arranged in a freely pivotable manner on the respective conveyor. This means that the respective loading clamp then pivots automatically when it is deflected from the top section to the bottom section of the conveyor and vice versa. It is also conceivable, however, for the respective loading clamp to be arranged in a specifically pivotable manner on the conveyor. In this case, the respective loading clamp is assigned pivoting drives which pivot the loading clamp in a specifically controlled manner in relation to the conveyor. The pivoting drives may be pneumatic pivoting drives or positive-guidance means.

According to a further configuration of the invention, the spreading clamps can be moved up to the two conveyors of each conveying arrangement, in particular can be moved downstream of the two conveyors of a respective loading station, such that a corner of the item of laundry can be transferred to a spreading clamp from a respective loading clamp of each conveyor. The conveyors allow the loading clamps to move relative to the spreading clamps in a manner appropriate for transfer, as a result of which the corners of the respective item of laundry can be transferred easily and reliably from the loading clamps to the spreading clamps.

Provision is preferably made for those ends of the conveyors oriented toward the spreading clamps to be assigned to the spreading clamps or the spreading arrangement such that the loading clamps move past the spreading clamps as the conveying strands are deflected, or just prior to the conveying strands being deflected, at those ends of the conveyors which are oriented toward the spreading clamps. This results in the spreading clamps being overtaken rapidly as the loading clamps are advanced by the conveyors, as a result of which the item of laundry is transferred reliably from the loading clamps to the spreading clamps.

The transfer of the corners of the respective item of laundry to the spreading clamps preferably takes place "on the run", that is to say as the loading clamps move past the spreading clamps, which are at a standstill for the transfer of the corners of the items of laundry. It is possible here for the loading clamps to be advanced at unaltered speed. It is also conceivable, however, for the conveyors to be provided with variable drives, in which case the loading clamps can be driven, as required, at different speeds. In particular, provision may be made for the conveyors to be driven more slowly during the phase of transferring the corners of the respective item of laundry to the spreading clamps, in which case the loading clamps move at reduced speeds past the spreading clamps, which are at a standstill, in order to transfer the item of laundry. Finally, it is also conceivable to stop the loading clamps briefly, that is to say to stop the conveyors momentarily, in order to transfer the item of laundry to the spreading clamps.

According to a further configuration of the invention, the loading clamps are assigned to a free side of the respective circulating conveying strand, to be precise are preferably fastened thereon. The free side of the respective circulating conveying strand is preferably constituted by the top side of the top section and the underside of the bottom section. In particular arranging the loading clamps on the top section means that the loading clamps are accessible to users in an ergonomically advantageous manner, allowing the items of laundry to be easily fitted into the loading clamps, which are upright in the top section, in a manner which does not tire out the operators. Once the item of laundry has been fitted in, the loading clamps, which retain the corners of an item of laundry, pass into the region of the bottom section, as a result of which the item of laundry can be transported to the higher-level spreading clamps in a state in which it hangs beneath the respective conveying arrangement, the item of laundry being raised at the same time. Before the loading clamps pass back to the top section on the top side of the conveying arrangement, the item of laundry is transferred to the spreading clamps from the loading clamps hanging beneath the respective bottom section, as a result of which the empty loading clamps do not disrupt the conveyor as they move back along the top section.

In the case of a further advantageous configuration of the apparatus, each conveying arrangement is assigned a measuring arrangement for determining the length of an edge of the item of laundry, preferably a front edge of the item of laundry. The item of laundry moves past the measuring arrangement as it is transported to the spreading clamps, as a result of which the measuring arrangement measures the length of the front border of the item of laundry reliably, and in particular without any time being wasted, or the measuring arrangement measures the as yet loosely hanging front edge of the not yet straightened-out item of laundry immediately following transfer of the latter to the spreading clamps.

The measuring arrangement assigned to each conveying arrangement is preferably arranged between the conveyors which are spaced apart, one beside the other. This means that the measuring arrangement can be accommodated in a space-saving manner and can be easily brought into contact with that edge of the item of laundry retained at opposite corners between two loading clamps which is to have its length measured, in particular the front edge of the item of laundry.

The measuring arrangement can be realized in various ways. The measuring arrangement preferably has a measuring stick which, at one end, can be pivoted about an axis of rotation running transversely to its longitudinal axis. The measuring stick can thus be moved between the two adjacent conveyors of each conveying arrangement and, during transportation to the spreading clamps the top border of the item of laundry, which top border is to be measured, comes into abutment against the measuring stick and pivots the latter to the extent where, once measurement has taken place, the front border of the item of laundry can pass by the free end of the measuring stick and reach the spreading clamps.

According to a further preferred configuration of the apparatus, provision is made for it to be possible to alter the height of the loading locations at which a respective corner of an item of laundry is fitted manually into the loading clamps. For example, the loading locations at which a respective operator is working can be set individually by the relevant operator to the height which is desirable for him, in particular to an ergonomically advantageous height. The height adjustment of the loading locations can take place in various ways. For example, it is possible to stop the loading clamps along the oblique top section of the conveyors at different spacings from the bottom, free end of each conveyor. As a result of the top section running obliquely, the loading clamps then stop at different heights in order for the corners of the respective item of laundry to be fitted in. It is also conceivable, however, for the conveyors to be pivoted about the ends oriented toward the spreading clamps, as a result of which the loading locations can assume different heights in the region of the lower-level, free end of each conveyor. Finally, it is also conceivable to raise or lower the conveyors as a whole, as a result of which the loading locations, at which the corners of an item of laundry are fitted manually into the loading clamps by the operator, alter in height correspondingly.

The individual heights of the loading locations which are set by the operators can preferably be stored in the control means of the apparatus. As he begins work, each operator can then retrieve his individually set height for the loading locations from the control means. The loading locations are then set automatically to the height level desired by the respective operator.

BRIEF DESCRIPTION OF THE DRAWINGS

A preferred exemplary embodiment of the apparatus will be explained in more detail hereinbelow with reference to the drawing, in which.

DETAILED DESCRIPTION OF PREFERRED EMBODIMENTS

Figure 1:
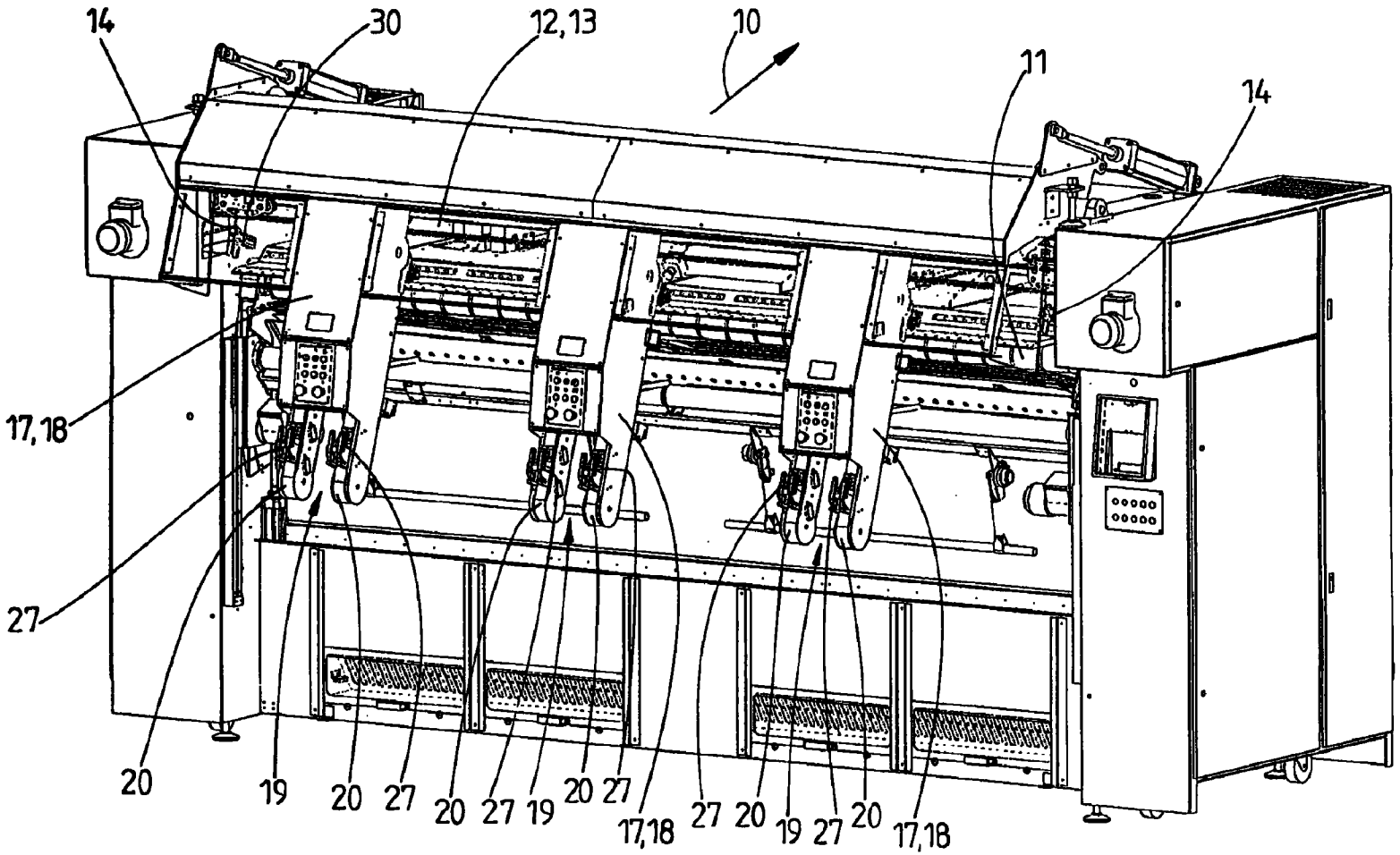
FIG. 1 shows a perspective overall view of the apparatus.
Figure 2:
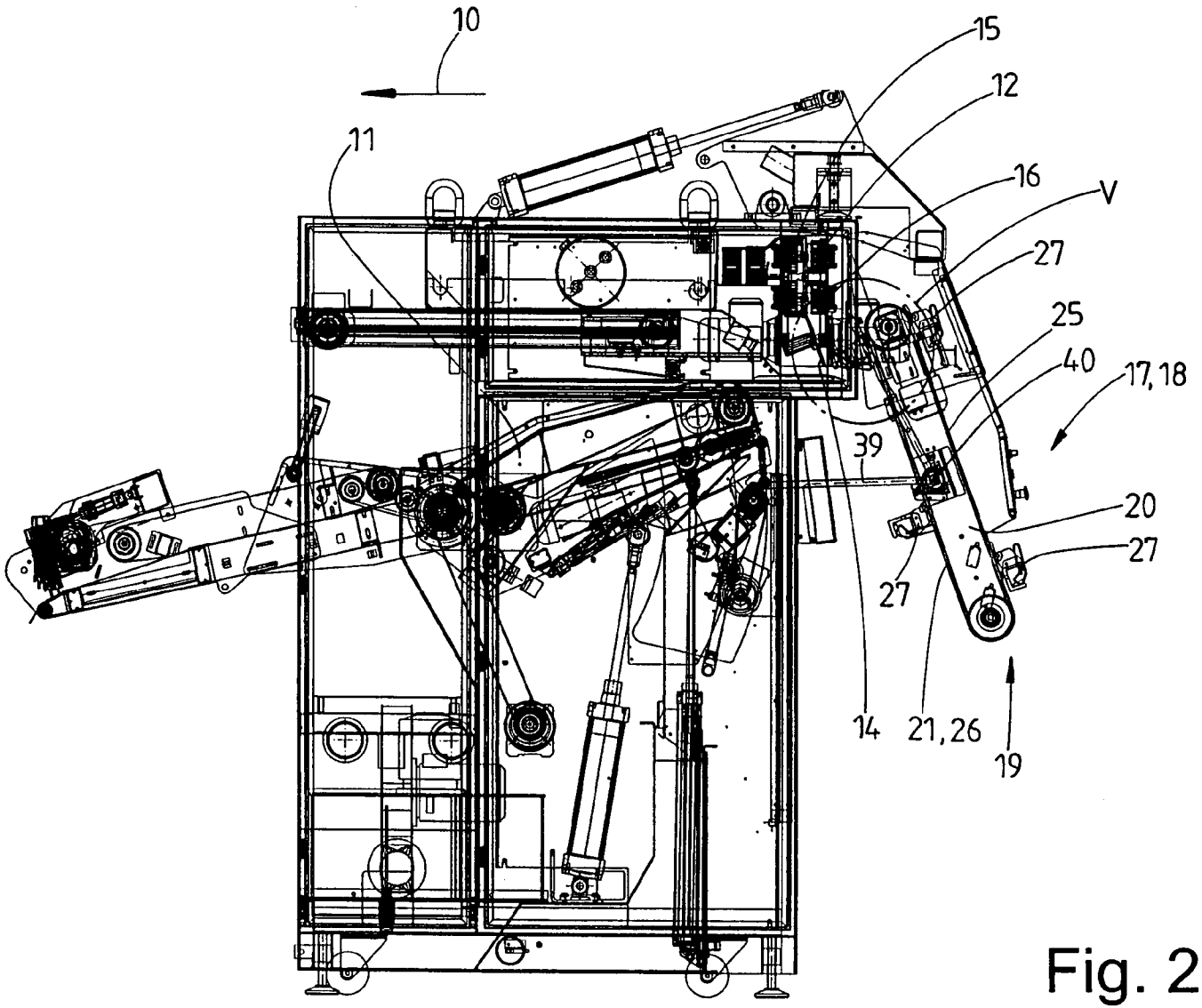
FIG. 2 shows a side view of the apparatus.

The apparatus which is shown here serves for feeding items of laundry (not shown in the figures), to be precise large items of laundry in particular, to a mangle or some other laundry-treatment arrangement. The mangle or other laundry-treatment arrangement is not shown in the figures. It is arranged downstream of the apparatus, as seen in the direction of introduction 10.

The apparatus has a feed conveyor 11 which is formed by at least one belt conveyor and by means of which an item of laundry is transported in the straightened-out state, in the direction of introduction 10, to the mangle, or some other laundry-treatment arrangement, located downstream of the feed conveyor 11. Upstream of the feed conveyor 11, as seen in the direction of introduction 10, the apparatus has a spreading arrangement 12, which has substantially at least one rail 13 which runs transversely to the direction of introduction 10 and on which, in the exemplary embodiment shown, two spreading clamps 14 can be displaced. It is also conceivable, however, for the spreading arrangement 12 to have a number of pairs of spreading clamps 14, which can be displaced on the same rail 13 or on separate rails. The two spreading clamps 14 of the apparatus shown here can be displaced independently of one another along the rail 13, transversely to the direction of introduction 10, by different drives 15, 16. Furthermore, the apparatus shown here has three loading stations 17, arranged upstream of the spreading arrangement 12, as seen in the direction of introduction 10. Two eccentric loading stations 17 are arranged on both sides of a central loading station 17. The loading stations 17 are identical. In contrast to the exemplary embodiment shown, it is also possible for the apparatus to have more than three loading stations 17 or fewer than three loading stations 17. If appropriate, just a single loading station 17 is provided.

Each of the identical loading stations 17 has a conveying arrangement 18, which slopes up obliquely in the direction of the spreading clamps 14, in order to raise a respective item of laundry mechanically. A bottom, free end of the conveying arrangement 18 is located in the region of a loading location 19. An opposite, top end of the conveying arrangement corresponds with the spreading arrangement 12, in particular the spreading clamps 14 of the same. The conveying arrangement 18 has two parallel, identical conveyors 20. The conveyors 20 of each conveying arrangement 18 are spaced apart parallel to one another.

According to the invention, each conveyor 20 is in the form of a conveyor which can be driven in circulation. For this purpose, each conveyor 20 has an endless conveying strand which, in the exemplary embodiment shown, is a flat, strap-like toothed belt 21. The toothed belt 21 of each conveyor 20 is deflected, at the bottom, loading location 19, at a deflecting drum 22 which can be rotated about a horizontal axis of rotation. At the opposite, top end upstream of the spreading arrangement 12, the toothed belt 21 of each conveyor 20 is deflected about a driving drum 23, which likewise has a horizontal axis of rotation. The driving drums 23 of the two conveyors 20 of the respective conveying arrangement 18 are driven synchronously together by a single drive motor 24, in the exemplary embodiment shown an electric motor, in particular a frequency-regulated and/or pole-changing electric motor. The endless toothed belt 21 of each conveyor 20, between the deflecting drum 22 and the driving drum 23, has an obliquely upwardly sloping top section 25 and a bottom section 26, which runs parallel to the top section.

In the case of the apparatus which is shown here, each conveyor 20 is provided with a plurality of identical loading clamps 27. In the exemplary embodiment shown, each conveyor 20 has three equally spaced-apart loading clamps 27. It is also conceivable, however, for each conveyor 20 to be assigned a larger or smaller number of loading clamps 27, it also being possible for each conveyor 20 to have just a single loading clamp 27. The loading clamps 27 are fastened on the smooth, outer sides of the toothed belt 21. Accordingly, the top side of the top section 25 and the underside of the bottom section 26 carry loading clamps 27. The loading clamps 27 of the adjacent conveyors 20 of each conveying arrangement 18 are assigned to the toothed belts 21 such that it is always the case that two loading clamps 27 are located opposite one another on an imaginary horizontal line, as a result of which opposite corners of a front edge of the item of laundry can be fitted into the opposite loading clamps 27, in which case the loading clamps 27 of each conveyor 20 of a conveying arrangement 18 retain adjacent corners of the item of laundry along an imaginary horizontal line.

The loading clamps 27 are assigned in a pivotable manner to the toothed belt 21. In the exemplary embodiment shown, for this purpose, the loading clamps 27 can be pivoted about horizontal pivot axes 37 in relation to the toothed belt 21. The pivotable loading clamps 27 are retained in each case by a retaining plate 38 which is fixed to the toothed belt 21 by screw connection and/or adhesive bonding. The pivotability in relation to the toothed belt 21 makes it possible for the loading clamps 27, on the one hand, to be moved into a position which is ergonomically advantageous for the item of laundry to be fitted in by the respective operator and, on the other hand, to pass into a different position in order for the item of laundry to be transferred to the spreading clamps 14. The loading clamps 27 are pivoted automatically as the toothed belts 21 are deflected both at the bottom, loading location 19 and at the top location of transfer to the spreading clamps 14. In order for an item of laundry to be fitted manually into the loading clamps 27 located at the bottom end of the top section 25 of each toothed belt 21, these loading clamps are pivoted such that they are located upstream of the retaining plate 38, in the direction of the loading location 19, and are supported on the top section 25, preferably on stop buffers. The elongate clamping mouths 28 of the loading clamps 27 here are oriented such that they run perpendicularly to the plane of the top section 25 and are open in the upward direction in order for an item of laundry to be fitted in easily. In the region of the bottom section 26, the loading clamps 27 are pivoted through preferably approximately 90° such that they hang beneath the respective retaining plate 38, the loading clamps 27 being pivoted onto the retaining plate 38 and being supported here such that the elongate clamping mouths 28 of the loading clamps 27 run approximately parallel to the bottom section 26 of each toothed belt 21, to be precise with the opening oriented downward in the direction of the loading location 19. The pivot axis 37 here is located some way above the loading clamps 27, in which case the loading clamps 27 cannot be pivoted any further in the counterclockwise direction, in relation to the illustration in FIG. 5, by the force exerted by the item of laundry hanging on the loading clamps 27, the clamping mouths 28 of the loading clamps 27 thus inevitably maintain their parallel orientation in relation to the bottom section 26 of their toothed belt 21.

Figure 3:
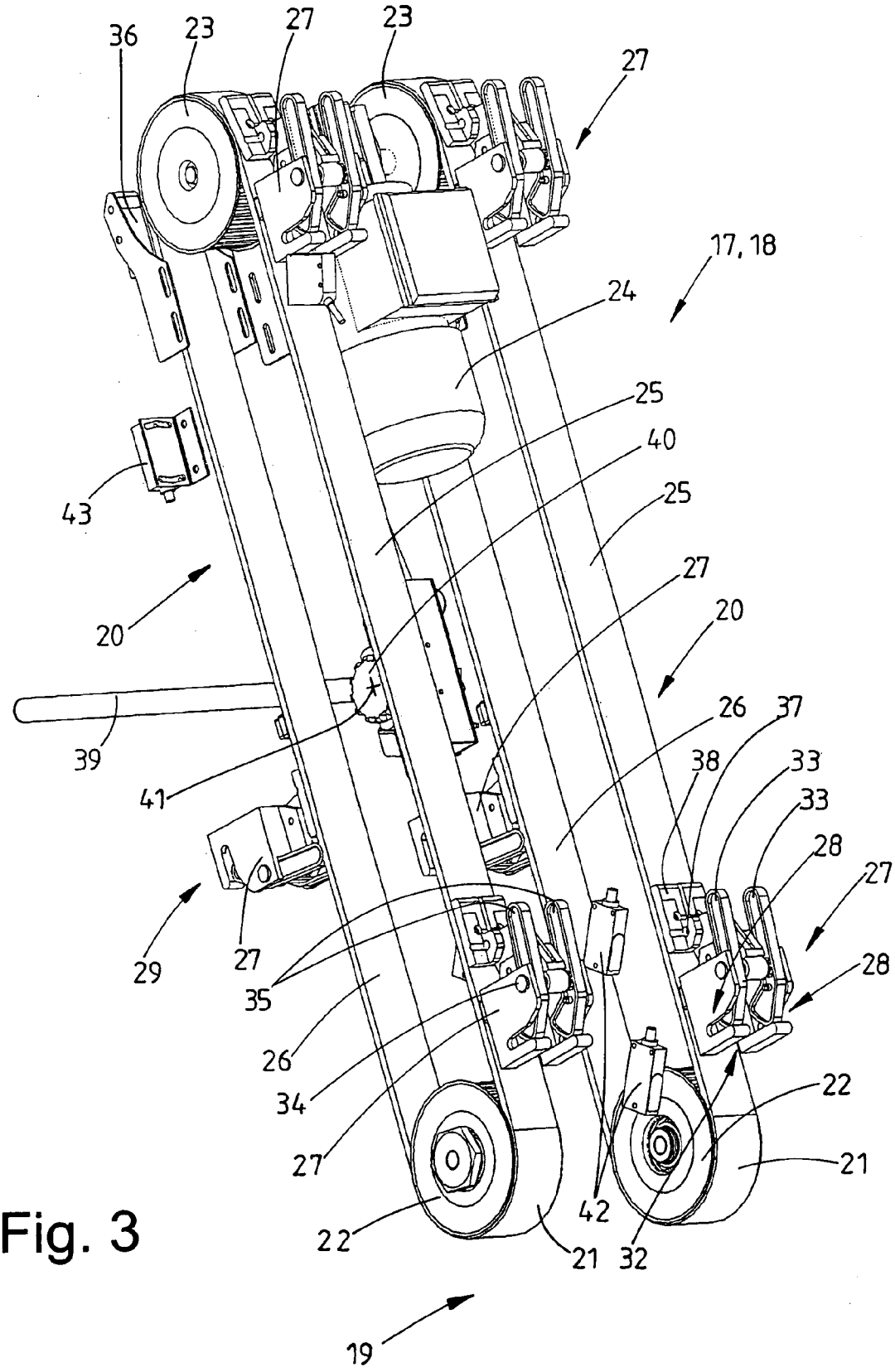
FIG. 3 shows a perspective view of a conveying arrangement in the region of a loading station of the apparatus.
Figure 4:
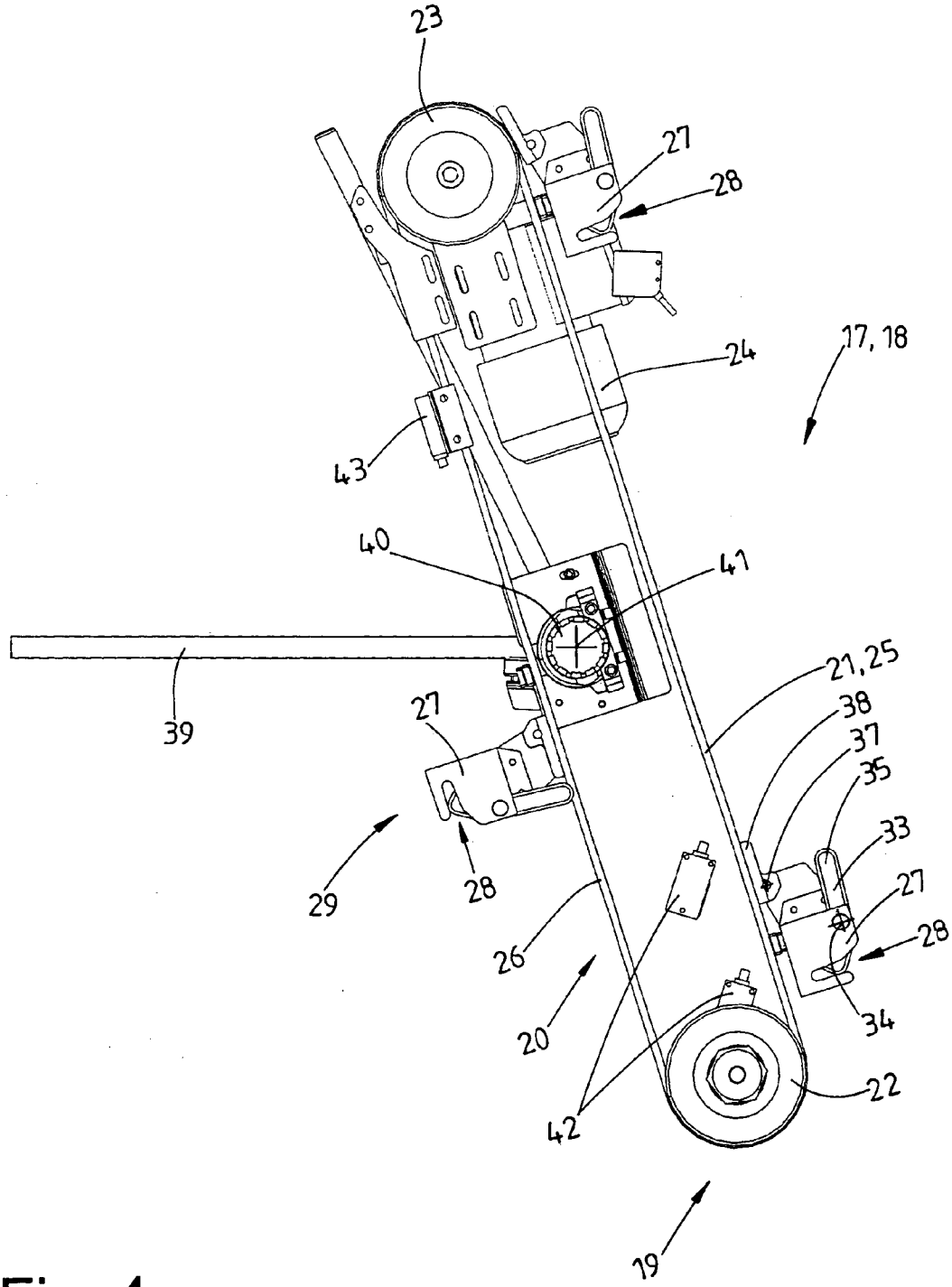
FIG. 4 shows a side view of the conveying arrangement from FIG. 3.

The conveying arrangements 18 of different loading stations 17 are driven in a discontinuous manner independently of one another. The independent driving action allows an item of laundry to be fitted into a pair of loading clamps 27 at each loading station 17 at a different point in time. An item of laundry is fitted into two adjacent loading clamps 27 of the respective conveying arrangement 18 during a momentary standstill of the drive means of the conveyors 20. The loading clamps 27 are then located in the position which is shown in FIG. 3. The bottom loading clamps 27 on the top section 25 of the respective toothed belt 21 here are located right upstream of the bottom loading location 19. The loading clamps 27 are then located in the vicinity of the bottom deflecting drum 22, to be precise in the end region of the top section 25 of the respective toothed belt 21. At the loading location 19, an item of laundry has its opposite corners fitted into these adjacent loading clamps 27 of the respective conveying arrangement 18 by the respective operator pushing the corners or corner regions of the item of laundry from above into the clamping mouths 28 of the two adjacent loading clamps 27. The loading clamps 27 are located at the bottom end of the top section 25 of each toothed belt 21, in the position which is particularly advantageous in ergonomic terms for the purpose of an item of laundry being fitted in. The operator can easily push the adjacent corners of a front edge of the item of laundry into the loading clamps 27 directed towards him, that is to say into the clamping mouths 28 of these loading clamps, and the item of laundry need only be partially raised, in which case the item of laundry can be fitted by the respective operator, at the bottom, loading location 19 of the conveying arrangement 18, into the free loading clamps 27 directed toward him without this requiring any great level of physical exertion.

While two adjacent loading clamps 27 of the respective conveying arrangement 18 are at a standstill at the loading location 19, a pair of loading clamps 27 with an item of laundry hanging thereon is positioned on the bottom section 26 between the opposite ends of the conveying arrangement 18, while the third pair of loading clamps 27 assumes a standby position on the top section 25 in the vicinity of the top driving drum 23. This means that, in the case of the conveying arrangement 18 being at a momentary standstill for the purpose of an item of laundry to be fitted in, there are no loading clamps 27 located in the region of the spreading clamps 14, in which case, as a new item of laundry is fitted in, the spreading clamps 14 can be displaced as desired without colliding with a loading clamp 27.

Once an item of laundry has been fitted into the loading clamps 27 at the loading location 19, the conveyors 20 are driven synchronously in circulation by the drive motor 24, to be precise only by the distance corresponding to the spacing between adjacent loading clamps 27 on each toothed belt 21. In the case of the exemplary embodiment which is shown here, with three loading clamps 27 assigned to each toothed belt 21, the two toothed belts 21 need to be driven synchronously only by the distance corresponding to a third of their length. Empty loading clamps 27 which follow are then to be found at the bottom, loading location 19. These are the loading clamps 27 from which an item of laundry has previously been transferred to the spreading clamps 14 and which, upon introduction of the previous item of laundry, were located at the top end of the respective top section 25, in the vicinity of the driving drum 23. Once the next two loading clamps 27 have been moved down to the loading location 19 along the top sections 25, the loading clamps 27 retaining an item of laundry previously fitted on at the loading station 17 are located in an intermediate position 29 beneath the conveying arrangement 18, that is to say along the bottom sections 26 of the toothed belts 21. In the exemplary embodiment shown, the loading clamps 27 carrying an item of laundry have moved away from the bottom deflecting drums 22 at the loading location 19 approximately by a distance corresponding to a third of the length of the bottom section 26. The item of laundry retained by the loading clamps 27 here hangs beneath the conveying arrangement 18. The last-introduced item of laundry is, as it were, stored in this intermediate position 29 until, by further circulating driving action of the conveyors 20, it is the next to be transferred to the spreading clamps 14 of the spreading arrangement 12.

Figure 5:
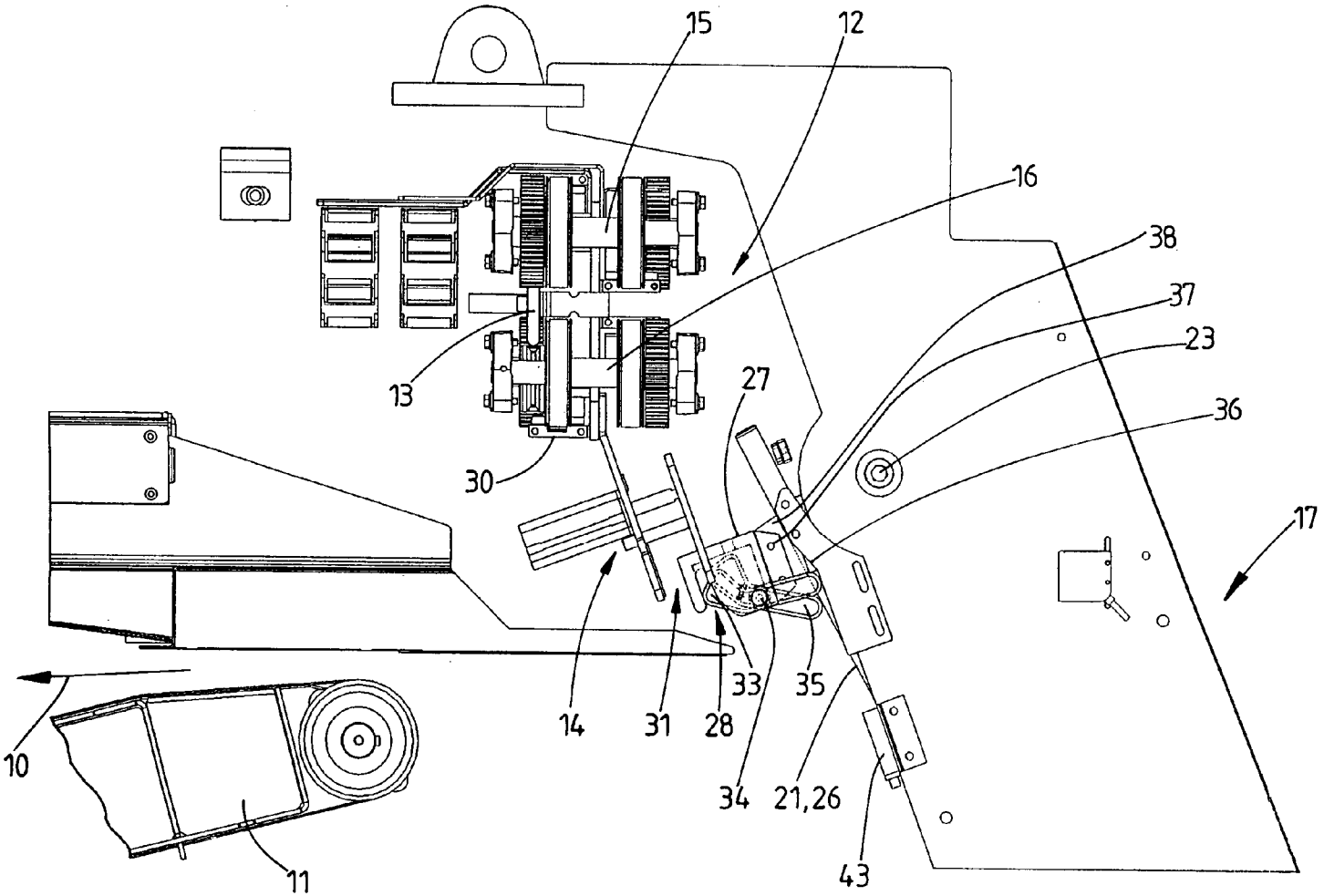
FIG. 5 shows a detail V from FIG. 2 in the region of transfer of an item of laundry from a loading clamp to a spreading clamp.

The transfer of an item of laundry from the loading clamps 27 to the spreading clamps 14 takes place as the conveyors 20 are driven. The loading clamps 27 here overtake the spreading clamps 14 of the spreading arrangement 12 which have been moved into the region of the loading clamps 27 and are now at a standstill. This overtaking of the spreading clamps 14 by the loading clamps 27 takes place at the top end of the bottom section 26 of each toothed belt 21, to be precise just upstream of the location where the toothed belts 21 are deflected around the driving drums 23 of the conveyors 20 (FIG. 5). In order to transfer the item of laundry from the loading clamps 27 to the spreading clamps 14, the spreading clamps 14, which can be displaced by a carriage 30 on the respective rail 13 of the spreading arrangement 12, are directed such that an elongate clamping mouth 31 of each spreading clamp 14 is spaced apart from the bottom section 26 of each toothed belt 21, parallel thereto, that is to say the oblique positioning of the spreading clamps 14, in particular of the clamping mouths 31 thereof, corresponds to the obliquely upwardly sloping course taken by the conveyors 20. The open ends of the clamping mouths 31 here are oriented downward in the direction of the loading location 19.

The spreading clamps 14 and the loading clamps 27 are dimensioned, and arranged on the carriage 30, on the one hand, and on the respective toothed belt 21, on the other hand, such that the clamping mouths 28 and 31 coincide, in particular, transversely to the direction of introduction 10. In order that the loading clamps 27 can overtake the spreading clamps 14 here, each loading clamp 27 has two spaced-apart, parallel clamping mouths 28. The comparatively narrow spreading clamp 14, with just a single clamping mouth 31, fits through between these identical clamping mouths 28 of each loading clamp 27. The two parallel clamping mouths 28 of each loading clamp 27 can thus move past on opposite sides of the spreading clamp 14. During this movement past the spreading clamp, or as the latter is overtaken, the narrow spreading clamp 14 passes into an interspace 32 between the parallel clamping mouths 28 of the respective loading clamp 27, the respective corner or the respective corner region of the item of laundry being transferred from the loading clamp 27 to the spreading clamp 14, to be precise as the conveyor 20 is driven in circulation. As soon as the clamping mouth 31 of the respective spreading clamps 14 is located between the clamping mouths 28 of the respective loading clamps 27—this being detected preferably by sensors, for example photocells 43—the spreading clamp 14 is closed by, for example, a pneumatic pressure-medium cylinder. At the same time, the clamping mouths 28 of each of the two loading clamps 27 at the loading station 17 are opened. This opening action takes place by virtue of a two-armed clamping lever 33 being pivoted, it being possible for this clamping lever to be rotated about a preferably approximately central horizontal pivot axis 34. The clamping levers 33 are pivoted by virtue of a free end 35 of each clamping lever 33 running past a correspondingly curved guide means 36, which is fixed on the housing of the respective loading station 17.

At least one loading station 17 is assigned a measuring arrangement. In the exemplary embodiment shown, each loading station 17 has a measuring arrangement. The respective measuring arrangement can be used to determine the length of the front or top border of the respective item of laundry. In the exemplary embodiment shown, the measuring arrangements of all the loading stations 17 are all formed by a respective pivotable measuring stick 39. The measuring stick 39 has one end mounted on an angle-of-rotation sensor 40 and it can thus be pivoted about a horizontal axis of rotation 41, which runs transversely to the longitudinal axis of the measuring stick 39. The measuring stick 39 can thus be moved in a vertical plane about the horizontal axis of rotation 41. This vertical plane is located centrally between the two conveyors 20 of each conveying arrangement 18. This vertical plane intersects an imaginary horizontal line of connection between the two spreading clamps 14 or adjacent loading clamps 27 on the adjacent toothed belts 21 of the respective conveying arrangement 18. The measuring principle of the measuring stick 39 with the angle-of-rotation sensor 40 corresponds to EP 0 548 797 A1, and reference is made in full to this document. Accordingly, the measuring stick 39 comes into abutment against the loosely hanging front edge of the item of laundry which is being retained between the spreading clamps 14. As the spreading clamps 14 begin to spread the item of laundry, the measuring stick 39 butting against the loosely hanging front edge of the item of laundry is pivoted, to be precise in the clockwise direction as seen in relation to the illustration of FIG. 3. The measuring stick 39 is carried along by the top border of the item of laundry, and pivoted in the process, until the free end of the measuring stick 39 loses contact with the loosely hanging front edge of the item of laundry. The pivoting angle of the measuring stick 39 established by the angle-of-rotation sensor 40 is used to calculate the length of the front edge of the item of laundry.

The photocell 42 is fixed in the region of the bottom section 26 of a toothed belt 21 of each conveying arrangement 18. The photocell 42 is located just upstream of the top end of the conveying arrangement 18. The photocell 42 here is arranged such that it detects an item of laundry which is hanging on the loading clamps 27 moving along or detects a loading clamp 27 moving along. The photocell 42 here emits a starting signal, as a result of which the distance over which the conveyors 20 are driven is determined. When a certain distance, dependent on the relative arrangement of the spreading clamps 14 in relation to the conveying arrangement 18, is reached, the two spreading clamps 14 which have been moved up to the respective loading station 17 in order to receive an item of laundry are closed automatically.

At least one further sensor means is assigned to the bottom end of the conveying arrangement 18. In the exemplary embodiment shown, this further sensor means is constituted by two slightly spaced-apart photocells 42. The photocells 42 serve to detect the presence of an item of laundry fitted into the loading clamps 27 at the loading location 19. If the presence of an item of laundry is established, driving of the conveyors 20 can be started automatically if the other requirements for this have been met, in particular if two spreading clamps 14 are present at the respective loading station 17, and the transfer of an item of laundry to the spreading clamps 14 can thus take place at the respective loading station 17.

The conveyors 20 at the respective loading station 17 are stopped in dependence either on the signal of the photocell 42 or on the distance covered by the same, this distance being constantly determined as the conveyors 20 are driven. It is possible here, if appropriate, to set, in a control circuit of the conveying arrangement 18, the spacing from the bottom end of the conveyors 20, that is to say the loading location 19, at which the driving action of the conveyors 20 is briefly stopped in order for an item of laundry to be fitted into the two loading clamps 27 which are currently to be found at the loading location 19. It is thus possible to make an individual setting—depending on the height of the operator—as to the height, that is to say the distance upstream of the bottom deflecting drums 22, at which the driving means of the conveyors 20 should be stopped in order for an item of laundry to be fitted in. This set value remains stored in the control means until it is changed. This means that the loading clamps 27 always stop at the loading location 19 in the same position corresponding to that height for fitting an item of laundry into the loading clamps 27 which is desired by the respective operator. When an operator begins work, inputting an individual identification code, for example a personal number, causes the control means to move the loading clamps 27 automatically to the height which was previously set by this operator.

LIST OF REFERENCE NUMBERS

10 Direction of introduction
11 Feed conveyor
12 Spreading arrangement
13 Rail
14 Spreading clamp
15 Drive
16 Drive
17 Loading station
18 Conveying arrangement
19 Loading location
20 Conveyor
21 Toothed belt
22 Deflecting drum
23 Driving drum
24 Drive motor
25 Top section
26 Bottom section
27 Loading clamp
28 Clamping mouth
29 Intermediate position
30 Carriage
31 Clamping mouth
32 Interspace
33 Clamping lever
34 Pivot axis
35 Free end
36 Guide means
37 Pivot axis
38 Retaining plate
39 Measuring stick
40 Angle-of-rotation sensor
41 Axis of rotation
42 Photocell
43 Photocell

The invention claimed is:

1. An apparatus for feeding items of laundry to a laundry-treatment arrangement having:
a feed conveyor (11),
a spreading arrangement (12) which is arranged upstream of the feed conveyor and has at least two spreading clamps (14) which can be displaced transversely upstream of the feed conveyor (11), and
at least one loading station (17) upstream of the spreading arrangement (12), the at least one loading station (17) having a loading location (19), which is arranged at a lower level than the spreading clamps (14), and at least one conveying arrangement (18), which slopes up obliquely to the higher-level spreading clamps (14) and has at least one loading clamp (27),
wherein the respective conveying arrangement (18) has at least one circulating conveyor (20), and wherein each conveyor (20) is assigned a plurality of the at least one loading clamp (27) which follow one after the other at intervals.

2. The apparatus according to claim 1, wherein the loading clamps (27) are arranged in a pivotable manner on the respective conveyor (20).

3. The apparatus according to claim 2, wherein the loading clamps (27) are arranged in a freely pivotable manner on the respective conveyor (20).

4. An apparatus for feeding items of laundry to a laundry-treatment arrangement having:
a feed conveyor (11),
a spreading arrangement (12) which is arranged upstream of the feed conveyor and has at least two spreading clamps (14) which can be displaced transversely upstream of the feed conveyor (11), and
at least one loading station (17) upstream of the spreading arrangement (12), the at least one loading station (17) having a loading location (19), which is arranged at a lower level than the spreading clamps (14), and at least one conveying arrangement (18), which slopes up obliquely to the higher-level spreading clamps (14) and has at least one loading clamp (27),
wherein the respective conveying arrangement (18) has at least one circulating conveyor (20), wherein the at least one loading clamp (27) is assigned to and arranged in a pivotable manner on the respective conveyor (20) and is driven directly by the conveyor (20) whereby the conveyor (20) advances and carries the at least one loading clamp (27), and wherein for transferring an item of laundry to the spreading clamps (14), the at least one loading clamp (27) can be pivoted into a relative position which differs from a loading position at the loading location (19).

5. The apparatus according to claim 2, wherein the loading clamp (27) is arranged in a specifically pivotable manner on the conveyor (20).

6. The apparatus according to claim 1, wherein the conveyor (20) has an endless conveying strand which is guided around at least one deflecting drum (22), which has a horizontal axis of rotation, and a driving drum (23) which likewise has a horizontal axis of rotation.

7. An apparatus for feeding items of laundry to a laundry-treatment arrangement having:
a feed conveyor (11),
a spreading arrangement (12) which is arranged upstream of the feed conveyor and has at least two spreading clamps (14) which can be displaced transversely upstream of the feed conveyor (11), and at least one loading station (17) upstream of the spreading arrangement (12), the at least one loading station (17) having a loading location (19), which is arranged at a lower level than the spreading clamps (14), and at least one conveying arrangement (18), which slopes up obliquely to the higher-level spreading clamps (14) and has at least one loading clamp (27), wherein the respective conveying arrangement (18) has at least one circulating conveyor (20), the conveyor (20) has an endless conveying strand which is guided around at least one deflecting drum (22), which has a horizontal axis of rotation, and a driving drum (23) which likewise has a horizontal axis of rotation, and wherein the at least one loading clamp (27) is fastened on the conveying strand of the conveyor (20).

8. The apparatus according to claim 7, wherein the conveying strands of the conveyor (20) are in the form of belts, toothed belts (21), cables or chains which are endless or have been made endless.

9. An apparatus for feeding items of laundry to a laundry-treatment arrangement having:

a feed conveyor (11), a spreading arrangement (12) which is arranged upstream of the feed conveyor and has at least two spreading clamps (14) which can be displaced transversely upstream of the feed conveyor (11), and at least one loading station (17) upstream of the spreading arrangement (12), the at least one loading station (17) having a loading location (19), which is arranged at a lower level than the spreading clamps (14), and at least one conveying arrangement (18), which slopes up obliquely to the higher-level spreading clamps (14) and has at least one loading clamp (27), wherein the respective conveying arrangement (18) has at least one circulating conveyor (20), the conveyor (20) has an endless conveying strand which is guided around at least one deflecting drum (22), which has a horizontal axis of rotation, and a driving drum (23) which likewise has a horizontal axis of rotation, and wherein a plurality of the at least one loading clamp (27) is fastened on the conveying strand of the conveyor (20).

10. The apparatus according to claim 1, wherein the conveying arrangement (18) at each loading station (17) has two parallel circulating conveyors (20).

11. The apparatus according to claim 10, wherein the two conveyors (20) of each conveying arrangement (18) can be driven synchronously in circulation.

12. The apparatus according to claim 10, wherein the two conveyors (20) of each conveying arrangement (18) are assigned the spreading clamps (14) such that a corner region of an item of laundry can be transferred to a spreading clamp (14) from the at least one loading clamp (27) of each conveyor (20).

13. An apparatus for feeding items of laundry to a laundry-treatment arrangement having:

a feed conveyor (11), a spreading arrangement (12) which is arranged upstream of the feed conveyor and has at least two spreading clamps (14) which can be displaced transversely upstream of the feed conveyor (11), and at least one loading station (17) upstream of the spreading arrangement (12), the at least one loading station (17) having a loading location (19), which is arranged at a lower level than the spreading clamps (14), and at least one conveying arrangement (18), which slopes up obliquely to the higher-level spreading clamps (14) and has at least one loading clamp (27), wherein the respective conveying arrangement (18) has at least one circulating conveyor (20), the conveying arrangement (18) at each loading station (17) has two parallel circulating conveyors (20), and wherein the conveyors (20) of each conveying arrangement (18) are assigned to the spreading clamps (14) such that the at least one loading clamp (27) can be moved past the spreading clamps (14) in order for the item of laundry to be transferred to the spreading clamps (14).

14. The apparatus according to claim 10, wherein the conveyors (20) can be driven at variable speed, and the loading clamps (27) can be driven momentarily at a lower speed in order to transfer an item of laundry to the spreading clamps (14).

15. An apparatus for feeding items of laundry to a laundry-treatment arrangement having:

a feed conveyor (11), a spreading arrangement (12) which is arranged upstream of the feed conveyor and has at least two spreading clamps (14) which can be displaced transversely upstream of the feed conveyor (11), and at least one loading station (17) upstream of the spreading arrangement (12), the at least one loading station (17) having a loading location (19), which is arranged at a lower level than the spreading clamps (14), and at least one conveying arrangement (18), which slopes up obliquely to the higher-level spreading clamps (14) and has at least one loading clamp (27), wherein the respective conveying arrangement (18) has at least one circulating conveyor (20), the conveying arrangement (18) at each loading station (17) has two parallel circulating conveyors (20), and wherein the at least one loading clamp (27) can be moved past the spreading clamps (14) as the conveying strands are deflected over a drum.

16. The apparatus according to claim 10, wherein the respective at least one loading clamp (27) is assigned to a free surface of the respective circulating conveying strand.

17. An apparatus for feeding items of laundry to a laundry-treatment arrangement having:

a feed conveyor (11), a spreading arrangement (12) which is arranged upstream of the feed conveyor and has at least two spreading clamps (14) which can be displaced transversely upstream of the feed conveyor (11), and at least one loading station (17) upstream of the spreading arrangement (12), the at least one loading station (17) having a loading location (19), which is arranged at a lower level than the spreading clamps (14), and at least one conveying arrangement (18), which slopes up obliquely to the higher-level spreading clamps (14) and has at least one loading clamp (27), wherein the respective conveying arrangement (18) has at least one circulating conveyor (20), the conveying arrangement (18) at each loading station (17) has two parallel circulating conveyors (20), and wherein in the loading position, the at least one loading clamp (27) is pivoted such that the corner regions of the items of laundry have clamp mouths (28) running perpendicularly to the top section (25) of the conveying strand and, in the position of transfer to the spreading clamps (14), the at least one loading clamp (27) is pivoted in relation to the loading position such that the corner regions of the items of laundry can be pulled out of the mouths (28) of the at least one loading clamp (27) parallel to the bottom section (26) of the conveying strand.

18. The apparatus according to claim 1, wherein each conveying arrangement (18) is assigned a measuring arrangement for determining the length of an edge of the item of laundry.

19. The apparatus according to claim 18, wherein the measuring arrangement is arranged between the conveyors (20) of the respective conveying arrangement (18), the conveyors being spaced apart one beside the other.

20. The apparatus according to claim 18, wherein the respective measuring arrangement has a measuring stick (39) which can be pivoted about a horizontal axis of rotation (41) running transversely to its longitudinal axis.

21. The apparatus according to claim 1, wherein the height of the loading locations (19) can be altered at which a respective corner region of an item of laundry can be fitted into the at least one loading clamp (27).

* * * * *